US011373523B2

(12) United States Patent
Qi et al.

(10) Patent No.: US 11,373,523 B2
(45) Date of Patent: Jun. 28, 2022

(54) METHOD FOR VEHICLE DETECTION BASED ON SINGLE-AXIS GEOMAGNETIC SENSOR

(71) Applicant: NANJING UNIVERSITY OF SCIENCE AND TECHNOLOGY, Nanjing (CN)

(72) Inventors: Yong Qi, Nanjing (CN); Xian Lv, Nanjing (CN); PengZhen Du, Nanjing (CN); WeiBin Zhang, Nanjing (CN)

(73) Assignee: Nanjing University of Science and Technology, Nanjing (CN)

( * ) Notice: Subject to any disclaimer, the term of this patent is extended or adjusted under 35 U.S.C. 154(b) by 0 days.

(21) Appl. No.: 16/969,896

(22) PCT Filed: Oct. 16, 2018

(86) PCT No.: PCT/CN2018/110363

§ 371 (c)(1),
(2) Date: Aug. 13, 2020

(87) PCT Pub. No.: WO2020/006925

PCT Pub. Date: Jan. 9, 2020

(65) Prior Publication Data

US 2021/0118291 A1 Apr. 22, 2021

(30) Foreign Application Priority Data

Jul. 5, 2018 (CN) ..... 201810732598.1

(51) Int. Cl.
*G08G 1/04* (2006.01)
*G08G 1/042* (2006.01)
(Continued)

(52) U.S. Cl.
CPC ..... *G08G 1/042* (2013.01); *G08G 1/052* (2013.01); *G08G 1/065* (2013.01)

(58) Field of Classification Search
CPC ..... G08G 1/042; G08G 1/052; G08G 1/065
See application file for complete search history.

(56) References Cited

U.S. PATENT DOCUMENTS

2006/0097894 A1* 5/2006 Kavaler ..... G08G 1/042 340/941
2012/0253648 A1* 10/2012 Kim ..... G08G 1/042 701/119

FOREIGN PATENT DOCUMENTS

CN 103123743 5/2013
CN 103354032 10/2013
(Continued)

OTHER PUBLICATIONS

Li, et al., "Vehicle Detection Algorithm Based on AMR Sensor". Transducer and Microsystem Technologies, Sep. 31, 2012, pp. 119-122.

(Continued)

*Primary Examiner* — Joseph H Feild
*Assistant Examiner* — Sharmin Akhter
(74) *Attorney, Agent, or Firm* — Jacquez Land Greenhaus & McFarland LLP; Bruce W. Greenhaus

(57) ABSTRACT

A method for vehicle detection based on single-axis geomagnetic sensor is disclosed. The method includes the following: arranging two geomagnetic sensors in tandem at a fixed distance in the same lane, and acquiring, by the two geomagnetic sensors, data when a vehicle passes by; performing data cleansing and denoising on the data acquired by the geomagnetic sensors; detecting, by the geomagnetic sensors, the vehicle by using an state machine algorithm based on a fixed threshold, and extracting moments when the vehicle enters and leaves detection ranges of the sensors; and collecting statistics on traffic flow in a predetermined period of time, and calculating the velocity and length of the vehicle. The presently disclosed method and apparatus can (Continued)

be independently used to obtain vehicle parameters at important traffic sections or intersections, or can be used in combination with other traffic detection devices to obtain more comprehensive traffic information. The presently disclosed method and apparatus has low power consumption, high detection sensitivity, is easy to install and resists the impact of a harsh environment.

6 Claims, 1 Drawing Sheet

(51) Int. Cl.
*G08G 1/052* (2006.01)
*G08G 1/065* (2006.01)

(56) References Cited

FOREIGN PATENT DOCUMENTS

| | | |
|---|---|---|
| CN | 103593984 | 2/2014 |
| CN | 204650760 | 9/2015 |
| CO | 201311713 | 9/2009 |
| WO | 0250795 | 6/2002 |

OTHER PUBLICATIONS

Yang, et al., "Vehicle Detection and Classification for Low-Speed Congested Traffic with Anisotropic Magnetoresistive Sensor". IEEE Sensors Journal, vol. 15, No. 2, Feb. 2015, pp. 1132-1138.

* cited by examiner

METHOD FOR VEHICLE DETECTION BASED ON SINGLE-AXIS GEOMAGNETIC SENSOR

CROSS-REFERENCE TO RELATED APPLICATIONS—CLAIM OF PRIORITY

The present application claims priority PCT Application No. PCT/CN2018/110363 filed Oct. 16, 2018, which claims priority to Chinese application No. 201810732598.1, filed Jul. 5, 2018, which are herein incorporated by reference in their entirety.

TECHNICAL FIELD

The disclosed method and apparatus relate to the field of vehicle detection technologies, and in particular, to a method for vehicle detection based on a single-axis geomagnetic sensor.

BACKGROUND

In intelligent transportation systems, the field of vehicle detection is the basis of, and among the most important links in such systems. At present, vehicle detection devices are mainly inductive loop detectors (ILDs), video cameras, and geomagnetic sensors. In the past few years, ILDs were widely used due to their simplicity and low cost. However, when ILDs are applied to traffic sensing, their identification accuracy is low because of their low sensitivity and poor anti-interference performance. Video cameras are used to analyze the license plate number or appearance of a vehicle to identify the type of vehicle. They are highly accurate, but expensive. In addition, video cameras impose very high transmission and processing performance requirements on a system due to the large amount of data generated for video identification. Moreover, there is a risk of privacy violations when using video cameras for vehicle identification. For example, data leakage can lead to a series of serious security problems.

Geomagnetic sensors add a new method of vehicle detection. This new method detects the interference in the geomagnetic field when a vehicle passes and obtains traffic information, such as traffic flow and road occupancy by identifying magnetic field signals of the vehicle. Furthermore, the velocity and length of the vehicle can be determined from changes in the geomagnetic field.

At present, the use of geomagnetic sensors having low power consumption, low cost and high sensitivity is a research hotspot in the field of vehicle detection. According to Li Yunlong et al, *Vehicle Detection Algorithm Based on AMR Sensor, Sensor and Microsystem,* 2012, a single three-axis Anisotropic Magnetic-Resistive (AMR) sensor can be used to measure changes in the strength of a geomagnetic field caused by a traveling vehicle. The data acquiring principle and waveform feature vector extraction method of the AMR sensor were studied and a vehicle detection algorithm based on an adaptive state machine was designed. To be specific, a threshold and a reference value were adaptively updated. However, the vehicle detection algorithm based on an adaptive state machine was relatively complex, imposed a high requirement on hardware, and could not deliver high accuracy vehicle detection. According to Bo Yang, *Vehicle Detection and Classification for Low-Speed Congested Traffic With Anisotropic Magnetoresistive Sensor*, Sensors Journal IEEE, 2015, in which a single three-axis AMR sensor was also used to acquire geomagnetic signals, a digital filter was used to process noise. A fixed threshold algorithm based on signal variance was designed to detect vehicles in low-speed congestion conditions on urban roads and vehicle types were identified by extracting waveform features. Although the algorithm could be used to identify vehicles in low-speed congestion conditions, the algorithm was highly complex, and could not identify vehicle types with a high level of accuracy from extracted waveform features and could not obtain more vehicle information.

In conclusion, most existing studies of vehicle detection have focused on the use of a single multi-axis geomagnetic sensor. While the use of a multi-axis sensor can obtain more geomagnetic signals of vehicles, such use increases the complexity of data post-processing and algorithm design and fails to deliver high quality real-time performance. In addition, vehicle information obtained by using a single geomagnetic sensor is limited, errors occur in vehicle detection, and large or small vehicles are easily missed.

SUMMARY

A method is disclosed for detecting vehicles based on a single-axis geomagnetic sensor, so as to obtain vehicle parameters such as traffic flow, vehicle velocity, and vehicle length, and provide authentic and reliable data on traffic management and control for a transportation department. The method comprises:

arranging two geomagnetic sensors in tandem at a fixed distance in the same lane, and acquiring, by the two geomagnetic sensors, data when a vehicle passes by;

performing data cleansing and denoising on the data acquired by the geomagnetic sensors;

detecting, by the geomagnetic sensors, the vehicle by using a state machine algorithm based on a fixed threshold, and extracting the time at which the vehicle enters and leaves detection ranges of the sensors; and collecting statistics on traffic flow over a predetermined period of time and calculating the velocity and length of the vehicle.

The method noted above can be further performed, wherein arranging of the two geomagnetic sensors comprises the two geomagnetic sensors having the same detection radius and the fixed distance being L; and two geomagnetic sensors being arranged at the center of a single lane in a deceleration zone, and forming a straight line parallel to a direction of travel of the vehicle.

In some embodiments, the performing data cleansing and denoising comprises:

in two sets of waveform data acquired by the geomagnetic sensors, determining that parts with the highest similarity represent accurate geomagnetic signal values; and waveforms with the highest similarity are periodically searched and comparisons made between the two sets of waveforms to determine similarities, and using the parts with the highest similarity as magnetic field signals of the vehicle after the denoising, where the similarity is measured based on a Euclidean distance.

Further, the state machine algorithm remains in a standby state and does not process a geomagnetic signal value until the geomagnetic signal value changes in a manner indicative of a vehicle entering the detection area;

wherein the sensor periodically acquires data;

wherein when the difference between a detected geomagnetic signal and a previous geomagnetic signal is greater than a predetermined fixed threshold as represented by the value of a variable Threshold, the sensor senses that the vehicle has arrived and records the time at which the vehicle arrived;

wherein when passing the sensor, the vehicle causes a magnetic field in a measurement range to shake, and causes a geomagnetic signal with vibration amplitude higher than a threshold to be acquired;

wherein when the vehicle leaves the detection area of the sensor, the detected geomagnetic signal returns to a stable value, indicating that the vehicle has left; and wherein the sensor records the time at which the vehicle had left, at which time data acquiring is complete and the sensor enters the standby state and waits for a next vehicle to arrive.

Further, wherein the collecting statistics on traffic flow in a predetermined period of time, and calculating the velocity and length of the vehicle comprises:

increasing a vehicle count by 1 if the two geomagnetic sensors detect similar geomagnetic signals, and collecting statistics on traffic flow in a single lane in the predetermined period of time;

calculating the vehicle velocity based on the difference between the times at which the vehicle arrives at the two sensors and the distance between the two sensors;

separately calculating: (1) vehicle lengths sensed by the two sensors based on differences between times at which the vehicle enters the detection ranges of the sensors and times at which the vehicle leaves the detection ranges, and (2) the calculated vehicle velocity; and calculating the average of the vehicle lengths as a finally obtained vehicle length.

Further, the detecting, by the geomagnetic sensors, the vehicle by using a state machine algorithm based on a fixed threshold, and extracting the times when the vehicle enters and leaves detection ranges of the sensors includes:

detecting, by the geomagnetic sensors, the vehicle by using the state machine algorithm based on a fixed threshold, that is, considering that the vehicle is detected when amplitude of geomagnetic field shaking caused when the vehicle enters the detection area of the sensor is greater than a specified threshold, and continuous shaking duration exceeds a predetermined value, where:

the value of a variable flag that determines whether a transition of the state machine occurs is defined as follows:

$$\text{flag} = \begin{cases} 1, \text{ if } \left|\sum_{k=1}^{4} Z_o(4i+k) - \sum_{k=1}^{4} Z_o[4(i-1)+k]\right| > Td \\ 0, \text{ otherwise} \end{cases},$$

where $Z_o$ denotes an original signal received by the geomagnetic sensor; $Z_o(4i+k)$ denotes the (4i+k)th geomagnetic signal acquired, and so on; i=0, 1, N, and k=1, 2, 3, 4, denoting series numbers; N denotes a series value; and Td denotes the predetermined threshold;

the value of the variable Threshold that represents the time threshold is determined by using the following formula:

$$\text{Threshold} = \frac{L_{min}}{4f * V_{max}},$$

where $L_{min}$ denotes the length of the smallest vehicle traveling on a road, $V_{max}$ denotes the maximum velocity limit of the road, and f denotes the operating frequency of the sensor;

in an initial state, all variables are reset to default values, the state machine is in an untriggered state, and in this case, the value of the variable flag is determined cyclically; and if the value of the variable flag remains unchanged, the state machine maintains its state; or if the value of the variable flag changes to 1, the state machine switches to a semi-triggered state, and the variable duration_t indicating the relative duration of the stay of the vehicle in the geomagnetic detection area increases by 1; and the value of the variable flag is determined cyclically; and the variable duration_t increases by 1 each time it is determined that the value of the variable flag remains unchanged; or when the value of the variable flag changes to 0, the variable duration_t is compared with the predetermined time threshold value represented by the variable Threshold; and if the value of the variable duration_t is less than the value of the variable Threshold, the state machine returns to the initial state and continues to monitor a subsequent vehicle; or if the variable duration_t is not less than the value of the variable Threshold, it is considered that the monitored vehicle leaves, the value of a variable vehicle_count representing the vehicle count increases by 1, and the state machine returns to its original state and waits for a next vehicle; and using the state machine algorithm based on a fixed threshold to detect a vehicle on a road section, and collecting statistics on traffic flow based on the value of the variable vehicle_count, where:

geomagnetic sensors A and B that are L apart and have the same signal frequency and detection radius are buried in tandem in the same lane, and obtained moments when the vehicle arrives at and leaves geomagnetic sensors A and B are $t_{a1}$, $t_{a2}$, $t_{b1}$, and $t_{b2}$, respectively;

a distance covered by the vehicle traveling from the detection area of sensor A to the detection area of sensor B is ΔL, and ΔL=L because geomagnetic sensors A and B have the same detection radius;

time required for covering ΔL is $t_1=t_{b1}-t_{a1}$;

therefore, the velocity at which the vehicle covers the distance is $V_1=L/t_1=L/(t_{b1}-t_{a1})$;

similarly, the velocity at which the vehicle leaves the detection areas of sensors A and B is $V_2=L/(t_{b2}-t_{a2})$; and in this case, the detected vehicle velocity is $V=(V_1+V_2)/2$.

Further, the collecting statistics on traffic flow in a predetermined period of time, and calculating the velocity and length of the vehicle includes:

calculating sensed vehicle velocities $V_1$ and $V_2$ based on difference $t_1$ between moments when the vehicle arrives at the two sensors and difference $t_2$ between moments when the vehicle leaves the two sensors, and the fixed distance L between the two sensors:

$$t_1=t_{b1}-t_{a1}$$

$$t_2=t_{b2}-t_{a2}$$

$$V_1=L/t_1$$

$$V_2=L/t_2;$$

using the average of all vehicle velocities calculated by sensors A and B as the velocity V of the traveling vehicle:

$$V=(V_1+V_2)/2;$$

calculating vehicle lengths $L_1$ and $L_2$ sensed by the two sensors based on differences $t_a$ and $t_b$ between moments when the vehicle enters the detection ranges of the sensors and moments when the vehicle leaves the detection ranges, and the calculated vehicle velocity V:

$$t_a=t_{a2}-t_{a1}$$

$$t_b=t_{b2}-t_{b1}$$

$$L_1=V*t_a$$

$$L_2=V*t_b; \text{ and}$$

calculating the average of the vehicle lengths as a finally obtained vehicle length L:

$$L=(L_1+L_2)/2.$$

In some embodiments of the disclosed method, the geomagnetic sensors are used to detect vehicles, delivering extremely high sensitivity. In addition, in some embodiments the geomagnetic sensors are directly arranged on two sides of the road or buried inside road studs, the geomagnetic sensors have long service lives and are easy to install and receive regular maintenance, and they are powered by easy-to-replace batteries, and feature low costs, resistance to impact of a harsh environment, and small sizes. In some embodiments, a vehicle detection algorithm is based on a fixed threshold, is simple and delivers a high detection rate and strong real-time performance.

DETAILED DESCRIPTION

Figure 1:
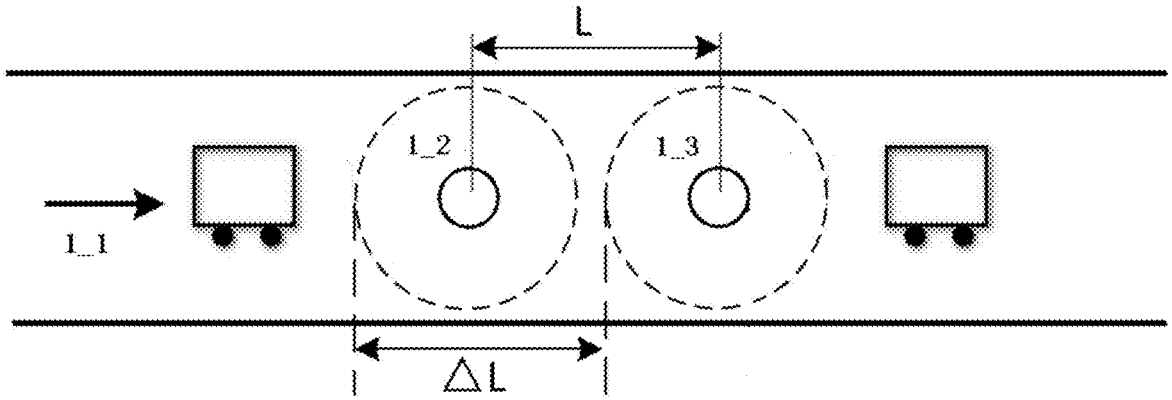
FIG. 1 is a schematic diagram of arranging geomagnetic sensors in a method for vehicle detection based on a single-axis geomagnetic sensor according to the presently disclosed method and apparatus.

FIG. 1 is a schematic diagram illustrating an arrangement of geomagnetic sensors in accordance with a method and apparatus for vehicle detection based on the use of a single-axis geomagnetic sensor. In the figure, 1-1 denotes the direction of travel of a vehicle, 1-2 denotes sensor A, and 1-3 denotes sensor B. The method comprises arranging two geomagnetic sensors in tandem at a fixed distance in the same lane, wherein the two geomagnetic sensors acquire data when a vehicle passes by.

Furthermore, the two geomagnetic sensors have the same detection radius, and are spaced apart by a fixed distance, L. Two geomagnetic sensors are arranged at the center of a single lane in a deceleration zone. A straight line formed by the two geomagnetic sensors is parallel to a direction if travel of the vehicle.

The method further comprises performing data cleansing and denoising on the data acquired by the geomagnetic sensors.

In some embodiments, two sets of waveform data are acquired by the geomagnetic sensors. Parts of the waveforms with the highest similarity are determined to be accurate geomagnetic signal values. In some such embodiments, waveforms with the highest similarity are searched through cyclic calculation and similarity comparison between the two sets of waveforms. These waveforms are used as magnetic field signals representative of the vehicle after the denoising, where a similarity measure was a Euclidean distance.

The method further comprises having the geomagnetic sensors detect the vehicle by using a state machine algorithm based on a fixed threshold, and extracting the time at which the vehicle enters and leaves detection ranges of the sensors.

Further, when the vehicle has not entered the detection area of the sensor nor has it left the detection area, the geomagnetic field will not have changed suddenly. In this case, the sensor is in a standby state and does not acquire a geomagnetic signal value at this moment.

When a vehicle is in the detection area, the geomagnetic field will shake violently; and in this case, the sensor records and acquires a geomagnetic signal value. Specifically, the sensor periodically acquires data. When the difference between a detected geomagnetic signal and a previous geomagnetic signal is greater than a predetermined fixed threshold, it is determined that the sensor has sensed that the vehicle arrived and the moment when the vehicle arrived is recorded. When passing the sensor, the vehicle causes a magnetic field in a measurement range to shake violently and a geomagnetic signal with vibration amplitude higher than a threshold is acquired. When the vehicle leaves, the detected geomagnetic signal returns to a stable value, indicating that the vehicle has left. The sensor records the moment when the vehicle left and data acquiring was completed. The sensor enters the standby state and waits for a next vehicle to arrive.

It is assumed that original data received by the geomagnetic sensor is:

$$Z_o=\{Z_o(1), Z_o(2), \ldots, Z_o(4i+k), \ldots\}(i=0, 1, \ldots, N; k=1, 2, 3, 4).$$

In the formula, $Z_o$ denotes an original signal received; $Z_o(1)$ denotes the first geomagnetic signal acquired, $Z_o(4i+k)$ denotes the (4i+k)th geomagnetic signal acquired, and so on; i and k denote series numbers; and N denotes a series value.

Data finally acquired by the geomagnetic sensor is:

$$Z=\{Z(1), Z(2), \ldots, Z(j), \ldots, Z(n)\}(j=1, 2, \ldots, n).$$

In the formula, Z denotes the finally acquired signal; Z(1) denotes the first geomagnetic signal acquired, Z(j) denotes the jth geomagnetic signal acquired, and so on; j denotes a series number; and n denotes a series value.

The corresponding time is:

$$t=\{t(1), t(2), \ldots, t(j), \ldots, t(n)\}(j=1, 2, \ldots, n).$$

In the formula, t denotes a time series corresponding to the acquired signal; t(1) denotes the time corresponding to the first geomagnetic signal acquired, t(j) denotes the time corresponding to the jth geomagnetic signal acquired, and so on; j denotes a serial number; n denotes a serial value; and $$\text{If } \left|\sum_{k=1}^{4} Z_o(4i+k) - \sum_{k=1}^{4} Z_o[4(i-1)+k]\right| > Td,$$

$$i=0, 1, \ldots, N, Z_j = \frac{\sum_{k=1}^{4} Z_o(4i+k)}{4}$$

Td denotes the predetermined threshold, and $Z_j$ denotes the average of four consecutive original geomagnetic signals.

Figure 2:
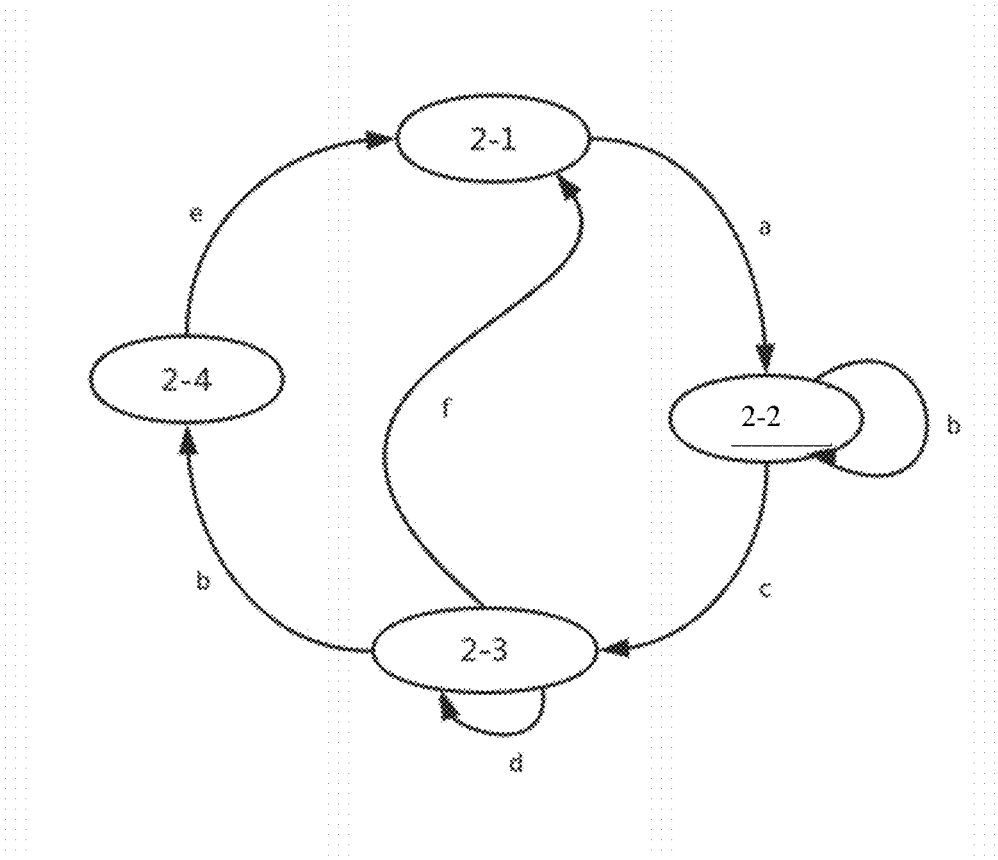
FIG. 2 is a schematic diagram of a state machine algorithm in a method for vehicle detection based on a single-axis geomagnetic sensor according to the presently disclosed method and apparatus.

FIG. 2 is a schematic diagram of a state machine algorithm that is used in one embodiment of a method for vehicle detection based on a single-axis geomagnetic sensor. In the figure, 2-1 denotes an initial state, 2-2 denotes an untriggered state, 2-3 denotes a semi-triggered state, and 2-4 denotes a triggered state. In addition, "a" denotes reset; "b" denotes condition 1 (If the variable flag=0); "c" denotes condition 2 (If the variable flag=1); "d" denotes condition 3 (If the variable flag=1) in which vehicle timing as indicated by the variable duration_t increases by 1, and a vehicle may enter; e denotes that the value of a variable vehicle_count representing the vehicle count increases by 1; and f denotes condition 4 (If the variable flag=0 and the value of the variable duration_t<the value of the variable Threshold), marked as noise. More details are as follows:

In some embodiments, the geomagnetic sensors detect the vehicle by using the state machine algorithm shown in FIG. 2, which is based on a fixed threshold. In accordance with the state machine algorithm, a vehicle is determined to have been detected when the amplitude of geomagnetic field indicates shaking caused by a vehicle entering the detection area of the sensor. This indication occurs when the amplitude of the shaking is greater than a specified threshold, and the shaking persists for a time that exceeds a predetermined value in time.

In some embodiments, a variable flag that can be used to determine a transition of the state machine is defined as follows:

$$\text{flag} = \begin{cases} 1, \text{ if } \left|\sum_{k=1}^{4} Z_o(4i+k) - \sum_{k=1}^{4} Z_o[4(i-1)+k]\right| > Td, \ i = 0, 1, \ldots N \\ 0, \text{ otherwise} \end{cases}.$$

In the formula, $Z_o$ denotes an original signal received by the geomagnetic sensor; $Z_o(4i+k)$ denotes the (4i+k)th geomagnetic signal acquired, and so on; i=0, 1, N, and k=1, 2, 3, 4, denoting series numbers; N denotes a series value; and Td denotes the predetermined threshold.

The time threshold Threshold was determined by using the following formula:

$$\text{Threshold} = \frac{L_{min}}{4f * V_{max}},$$

In the formula, $L_{min}$ denotes the length of the smallest vehicle traveling on a road, $V_{max}$ denotes the maximum velocity limit of the road, and f denotes the operating frequency of the sensor.

In the initial state 2-1, all variables are reset to default values and the state machine moves to the untriggered state 2-2. In this case, the value of the variable flag is determined periodically. If the value of the variable flag remains unchanged, the state machine remains in the same state (i.e., the untriggered state 2-2). If the value of the variable flag changes to 1, the state machine moves to the semi-triggered state 2-3. In this case, it is considered possible that a vehicle has passed by, and a variable duration_t, indicating the duration (i.e., the relative amount of time) the vehicle stayed in the geomagnetic detection area is increased by 1. As noted above, the value of the variable flag is determined periodically and the value of the variable duration_t increases by 1 for each period in which it is determined that the value of the variable flag remained unchanged. When the value of the variable flag changes to 0, the variable duration_t is compared with the value of the predetermined time threshold variable Threshold. If the variable duration_t is less than the value of the variable Threshold, the acquired geomagnetic signal is considered to have possibly been caused by a vehicle in a nearby lane, and thus is considered to be noise. In this case, the state machine returns to the initial state 2-1 and continues to monitor for subsequent vehicles. If the variable duration_t was not less than Threshold, the monitored vehicle is considered to have left, and a variable representing the vehicle count (i.e., the variable vehicle_count) is increased by 1. The state machine then returns to the untriggered state 2-2 and waits for a next vehicle.

It can be seen that the state machine algorithm based on a fixed threshold can be used to detect a vehicle on a section of a road, and to collect statistics on traffic flow based on the value of a variable vehicle_count.

Geomagnetic sensors A and B that are spaced apart by a distance L (L is relatively small) and that have the same signal frequency and detection radius are buried in tandem in the same lane. When a vehicle passes the two geomagnetic sensors, it could be considered that the vehicle passed at a constant velocity because the distance between the sensors was relatively small. The state machine vehicle detection algorithm based on a fixed threshold could be used to obtain the points in time at which a vehicle enters and leaves the detection area of the geomagnetic sensors A and B, which were ta1, ta2, tb1, and tb2, respectively.

A distance covered by the vehicle traveling from the detection area of sensor A to the detection area of sensor B was ΔL, and ΔL=L because geomagnetic sensors A and B had the same detection radius.

Time required for covering ΔL was $t_1=t_{b1}-t_{a1}$.

Therefore, the velocity at which the vehicle covered the distance was $V_1=L/t_1=L/(t_{b1}-t_{a1})$.

Similarly, the velocity at which the vehicle left the detection areas of sensors A and B was $V_2=L/(t_{b2}-t_{a2})$.

In this case, the detected vehicle velocity is $V=(V_1+V_2)/2$, and statistics on traffic flow in a predetermined period of time are collected and the velocity and length of the vehicle is calculated.

On the basis of the state machine detection algorithm based on a fixed threshold, if the two geomagnetic sensors detected similar geomagnetic signals, the vehicle count increases by 1, and statistics on traffic flow in a single lane in the predetermined period of time are collected. The vehicle velocity is calculated based on the difference between the times at which the vehicle arrived at the two sensors and the distance between the two sensors. The vehicle lengths sensed by the two sensors are separately calculated based on differences between relative time at which the vehicle entered the detection ranges of the sensors and the relative time at which the vehicle left the detection ranges, and the calculated vehicle velocity. The average of the vehicle lengths is then used as a finally obtained vehicle length.

Furthermore, if the two geomagnetic sensors detected similar geomagnetic signals, the vehicle count is increased by 1 and statistics on traffic flow in a single lane in a certain period of time are collected. Sensed vehicle velocities $V_1$ and $V_2$ are calculated based on the difference $t_1$ between the times at which the vehicle arrived at each of the two sensors, the difference $t_2$ between times at which the vehicle left each of the two sensors and the fixed distance L between the two sensors:

$$t_1=t_{b1}-t_{a1}$$

$$t_2=t_{b2}-t_{a2}$$

$$V_1=L/t_1$$

$$V_2=L/t_2.$$

The average of all vehicle velocities calculated by sensors A and B is used as the velocity V of the traveling vehicle:

$$V=(V+V_2)/2.$$

Vehicle lengths $L_1$ and $L_2$ sensed by the two sensors are separately calculated based on differences $t_a$ and $t_b$ between time at which the vehicle entered the detection ranges of the sensors and times at which the vehicle left the detection ranges, and the calculated vehicle velocity V:

$$t_a=t_{a2}-t_{a1}$$

$$t_b=t_{b2}-t_{b1}$$

$$L_1=V*t_a$$

$$L_2=V*t_b.$$

The average of the vehicle lengths is calculated as the finally obtained vehicle length L:

$$L=(L_1+L_2)/2.$$

In conclusion, in the presently disclosed method and apparatus the geomagnetic sensors are used to detect vehicles and deliver extremely high sensitivity. Directly arranged on two sides of the road or buried inside road studs, the geomagnetic sensors have long service lives and are easy to install and maintain on a regular basis. In addition, they are powered by easy-to-replace batteries, and feature low costs, resistance to impact of a harsh environment, and are available in small sizes. Finally, the vehicle detection algorithm based on a fixed threshold is simple and delivers a high detection rate and strong real-time performance.

What is claimed is:

1. A method for vehicle detection based on a single-axis geomagnetic sensor, comprising:

arranging two geomagnetic sensors in tandem at a fixed distance in the same lane, and acquiring , by the two geomagnetic sensors, data when a vehicle passes by;

performing data cleansing and denoising on the data acquired by the geomagnetic sensors;

detecting, by the geomagnetic sensors, the vehicle by using a state machine algorithm based on a fixed threshold, and extracting the time at which the vehicle enters and leaves detection ranges of the sensors; and collecting statistics on traffic flow over a predetermined period of time and calculating the velocity and length of the vehicle;

wherein the detecting comprises: considering that the vehicle is detected when amplitude of geomagnetic field shaking caused when the vehicle enters the detection area of the sensor is greater than a specified threshold, and continuous shaking duration exceeds a predetermined value, wherein:

a variable flag that determines a transition of the state machine is defined as:

$$\text{flag}=\begin{cases}1, & \text{if } \left|\sum_{k=1}^{4} Z_o(4i+k)-\sum_{k=1}^{4} Z_o[4(i-1)+k]\right|>Td \\ 0, & \text{otherwise}\end{cases},$$

wherein:

$Z_o$ denotes an original signal received by the geomagnetic sensor; $Z_o(4i+k)$ denotes the (4i+k)th geomagnetic signal acquired, and so on; i=0, 1, . . . , N, and k=1, 2, 3, 4, denoting series numbers; N denotes a series value; and Td denotes the predetermined threshold;

the time threshold Threshold is determined by using the following formula:

$$\text{Threshold}=\frac{L_{min}}{4f*V_{max}}$$

wherein:

$L_{min}$ denotes the length of the smallest vehicle traveling on a road, $V_{max}$ denotes the maximum velocity limit of the road, and f denotes the operating frequency of the sensor;

in an initial state, all variables are reset to default values, the state machine is in an untriggered state, and the value of the variable flag is determined periodically; and if the value of the variable flag remains unchanged, the state machine maintains its state; or if the value of the variable flag changes to 1, the state machine switches to a semi-triggered state, and the variable duration_t indicating the relative duration of the stay of the vehicle in the geomagnetic detection area increases by 1; and the value of the variable flag is determined periodically and the variable duration_t increases by each time it is determined that the value of the variable flag remains unchanged;

the variable duration_t increases by 1 each time it is determined that the value of the variable flag remains unchanged over the period used to determine the value of the variable flag; when the value of the variable flag changes to 0, the variable the variable duration_t is compared with the value of a predetermined time threshold maintained in the variable Threshold; and if the value of the variable duration_t is less than the value of the variable Threshold, the state machine returns to the initial state and continues to monitor a subsequent vehicle; or if the value of the variable duration_t is not less than the value of the variable Threshold, it is considered that the monitored vehicle leaves, the value of a variable vehicle_count representing the vehicle count increases by 1, and the state machine returns to its original state and waits for a next vehicle; and using the state machine algorithm based on a fixed threshold to detect a vehicle on a road section, and collecting statistics on traffic flow based on the value of the variable vehicle_count, wherein:

geomagnetic sensors A and B that are L apart and have the same signal frequency and detection radius are buried in tandem in the same lane, and obtained moments when the vehicle arrives at and leaves geomagnetic sensors A and B are $t_{a1}$, $t_{a2}$, $t_{b1}$, and $t_{b2}$, respectively;

a distance covered by the vehicle traveling from the detection area of sensor A to the detection area of sensor B is ΔL, and ΔL=L because geomagnetic sensors A and B have the same detection radius;

time required for covering ΔL is $t_1=t_{b1}-t_{a1}$;

therefore, the velocity at which the vehicle covers the distance is $V_1=L/t_1=L(t_{b1}-t_{a1})$;

similarly, the velocity at which the vehicle leaves the detection areas of sensors A and B is $V_2=L/(t_{b2}-t_{a2})$; and in this case, the detected vehicle velocity is $V=(V_1+V_2)/2$.

2. The method of claim 1, wherein the arranging two geomagnetic sensors comprises: the two geomagnetic sensors having the same detection radius and the fixed distance being L, the two geomagnetic sensors being arranged at the center of a single lane in a deceleration zone and forming a straight line parallel to a direction of travel of the vehicle.

3. The method of claim 1, wherein the performing data cleansing and denoising comprises:

in two sets of waveform data acquired by the geomagnetic sensors, determining that parts with the highest similarity represent accurate geomagnetic signal values and waveforms with the highest similarity are periodically searched and similarity comparisons made between the two sets of waveforms to determine similarities, and using the parts with the highest similarity as magnetic field signals of the vehicle after the denoising, wherein the similarity is measured based on a Euclidean distance.

4. The method of claim 1, wherein the state machine algorithm remains in a standby state and does not process a geomagnetic signal value until the geomagnetic signal value changes in a manner indicative of a vehicle entering the detection area;

wherein the sensor periodically acquires data;

wherein when the difference between a detected geomagnetic signal and a previous geomagnetic signal is greater than a predetermined fixed threshold, the sensor sensors that the vehicle has arrived and records the time at which the vehicle arrived; and when passing the sensor, the vehicle causes a magnetic field in a measurement range to shake, and causes a geomagnetic signal with vibration amplitude higher than a threshold to be acquired; and wherein when the vehicle leaves the detection area of the sensor, the detected geomagnetic signal returns to a stable value, indicating that the vehicle has left;

wherein the sensor records the moment when the vehicle leaves, at which the time data acquiring is completed; and the sensor enters the standby state, waiting for a next vehicle to arrive.

5. The method of claim 1, wherein the collecting statistics on traffic flow in a predetermined period of time, and calculating the velocity and length of the vehicle comprises:

increasing a vehicle count by 1 if the two geomagnetic sensors detect similar geomagnetic signals;

collecting statistics on traffic flow in a single lane in the calculating the vehicle velocity based on: (1) the difference between the times at which the vehicle arrives at the two sensors; and (2) the distance between the two sensors;

separately calculating: (1) vehicle lengths sensed by the two sensors based on differences between times at which the vehicle enters the detection ranges of the sensors and the times when the vehicle leaves the detection ranges; and the vehicle velocity; and calculating the average of the vehicle lengths as a finally obtained vehicle length.

6. The method of claim 1, wherein the collecting statistics on traffic flow in a predetermined period of time, and calculating the velocity and length of the vehicle comprises:

calculating sensed vehicle velocities $V_1$ and $V_2$ based on difference ti between the time at which the vehicle arrives at the two sensors and difference $t_2$ between time at which the vehicle leaves the two sensors, and the fixed distance L between the two sensors:

$$t_1=t_{b1}-t_{a1}$$

$$t_2=t_{b2}-t_{a2}$$

$$V_1=L/t_1$$

$$V_2=L/t_2;$$

using the average of all vehicle velocities calculated by sensors A and B as the velocity V of the traveling vehicle:

$$V=(V_1+V_2)/2$$

calculating vehicle lengths $L_1$ and $L_2$ sensed by the two sensors based on differences $t_a$ and $t_b$ between moments when the vehicle enters the detection ranges of the sensors and moments when the vehicle leaves the detection ranges, and the calculated vehicle velocity V;

$$t_a=t_{a2}-t_{a1}$$

$$t_b=t_{b2}-t_{b1}$$

$$L_1=V*t_a$$

$$L_2=V*t_b;\text{ and}$$

calculating the average of the vehicle lengths as a finally obtained vehicle length L:

$$L=(L_1+L_2)/2.$$

$$t_1=t_{b1}-t_{a1}$$

$$t_2=t_{b2}-t_{a2}$$

$$V_1=L/t_1$$

$$V_2=L/t_2;$$

using the average of all vehicle velocities calculated by sensors A and B as the velocity V of the traveling vehicle:

$$V=(V_1+V_2)/2$$

calculating vehicle lengths $L_1$ and $L_2$ sensed by the two sensors based on differences $t_a$ and $t_b$ between moments when the vehicle enters the detection ranges of the sensors and moments when the vehicle leaves the detection ranges, and the calculated vehicle velocity V:

$$t_a=t_{a2}-t_{a1}$$

$$t_b=t_{b2}-t_{b1}$$

$$L_1=V*t_a$$

$$L_2=V*t_b;\text{ and}$$

calculating the average of the vehicle lengths as a finally obtained vehicle length L:

$$L=(L_1+L_2)/2.$$

* * * * *